US007777646B2

(12) United States Patent
Konforty et al.

(10) Patent No.: US 7,777,646 B2
(45) Date of Patent: Aug. 17, 2010

(54) ALERTING A DRIVER TO THE PRESENCE OF A PEDESTRIAN ON A ROAD

(76) Inventors: Moshe Konforty, 12 Menora St., Givataim 53489 (IL); Yuval Erez, 14 Anzo Sireni St., Givataim 53241 (IL); Omer Bernard Ben Dor, 24/46 Levi Ashkol St., Kiryat Ono 55602 (IL)

( * ) Notice: Subject to any disclaimer, the term of this patent is extended or adjusted under 35 U.S.C. 154(b) by 480 days.

(21) Appl. No.: 11/867,020

(22) Filed: Oct. 4, 2007

(65) Prior Publication Data

US 2009/0091474 A1 Apr. 9, 2009

(51) Int. Cl.
*G08G 1/07* (2006.01)

(52) U.S. Cl. ..... 340/925; 340/436; 340/944; 116/63 R

(58) Field of Classification Search ..... 340/436, 340/907, 925, 944, 463; 116/63 R
See application file for complete search history.

(56) References Cited

U.S. PATENT DOCUMENTS

| | | | | |
|---|---|---|---|---|
| 5,734,339 | A * | 3/1998 | Ogle | 340/944 |
| 6,384,742 | B1 * | 5/2002 | Harrison | 340/944 |
| 6,597,293 | B1 * | 7/2003 | Harrison | 340/944 |

FOREIGN PATENT DOCUMENTS

| | | | |
|---|---|---|---|
| DE | 3322504 | | 1/1985 |
| GB | 2341712 | | 3/2000 |
| JP | 11081256 | A * | 3/1999 |
| JP | 2006265989 | | 10/2006 |

* cited by examiner

*Primary Examiner*—Toan N Pham
*Assistant Examiner*—Kerri McNally
(74) *Attorney, Agent, or Firm*—Martin Fleit; Paul D. Bianco; Fleit Gibbons Gutman Bongini & Bianco PL

(57) ABSTRACT

System and method alerting drivers approaching a pedestrian crossing and notifying them of the presence of a pedestrian on the pedestrian crossing or any other accidents-prone road sections. By this, an additional traffic safety measure is provided. The presence of the pedestrian crossing marking is not always sufficient. Thus, the proposed system and method are also directed at providing a forgiving infrastructure for both inattentive drivers and jaywalking pedestrians. The system and method utilize movement and weight sensors to detect a movement upon a pedestrian crossing and its vicinity. After negating a possibility that this movement is caused by a passing vehicle, the system invokes illuminating indicators directed at approaching drivers, alerting them to the presence of a pedestrian on the pedestrian crossing. The system may be calibrated to optimize the detection rate, minimizing false alarm and no detection.

16 Claims, 2 Drawing Sheets

ALERTING A DRIVER TO THE PRESENCE OF A PEDESTRIAN ON A ROAD

FIELD OF THE INVENTION

The present invention relates to traffic safety measures, and more particularly to safety measures directed to alert drivers to the presence of a pedestrian on a pedestrian crossing.

BACKGROUND OF THE INVENTION

Many fatal road accidents occur on a pedestrian crossing. One of the reasons for this is that pedestrians usually regard the pedestrian crossing as a safe haven on the traffic lane. This misleading notion causes some pedestrian to be less cautious while crossing the road on a pedestrian crossing when compared to crossing a road in a place where no pedestrian crossing exists.

Several attempts to provide extra safety measures and alert drivers to the presence of a pedestrian in the proximity of a pedestrian crossing are known in the art. British patent No. GB2341712, which is incorporated by reference herein in its entirety, discloses a road crossing system with rows of lights perpendicular to the direction of the road with a control device lying proximal to the end of these rows one on either side. The control device is connected to an activation device which when operated causes the lights to turn on. The control device is invoked by proximity devices which may be constructed and arranged to respond only when a person moves on the sidewalk towards the road. The main drawback of this system is that it detects the pedestrian only when he or she are on the sidewalk and has not yet set a foot on the road.

German patent No. DE3322504 which is incorporated by reference herein in its entirety discloses a system which addresses a situation where a vehicle is waiting in front of the pedestrian crossing for a pedestrian to cross. According to this invention the vehicle triggers a contact by means of an electromagnetic induction loop. As a result, all other approaching vehicles are warned that pedestrians are crossing.

Japanese patent application No. JP2006265989 which is incorporated by reference herein in its entirety discloses a traffic safety system allowing a driver of a vehicle traveling toward a pedestrian crossing at night to recognize the presence of a pedestrian crossing on the pedestrian crossing. This system comprises a detecting sensor for detecting the pedestrian trying to cross on the pedestrian crossing and a light emitting means arranged on a road surface in close vicinity to the pedestrian crossing and emitting the light toward the pedestrian or the bicycle crossing on the pedestrian crossing when the detecting sensor detects the pedestrian. The main drawback of this invention is that the sensor may not differentiate between a pedestrian and a vehicle thus causing a large amount of false alarms.

SUMMARY OF THE INVENTION

The disclosed system and method alert drivers approaching pedestrian crossing and other accident prone road sections (i.e., near a school or under a bridge) and notify them of the presence of a pedestrian on the road. By this, the present invention provides an additional traffic safety measure. The presence of the pedestrian crossing marking is not always enough. Thus, the present invention is also directed at providing a forgiving infrastructure for both inattentive drivers and jaywalking pedestrians. The system and method utilize two sensors: the first sensor detects an object on the road and the second sensor affirms that the object is not a passing vehicle. Then and only then—illuminating indicators are invoked.

In some embodiments of the invention, the system comprises movement and weight sensors at any combination to detect a movement upon a pedestrian crossing or any other predetermined section of the road. After negating a possibility that this movement is caused by a passing vehicle, the system invokes illuminating indicators directed at approaching drivers, alerting them to the presence of a pedestrian on the pedestrian crossing. The system may be calibrated to optimize the detection rate, minimizing false alarms and no detection.

BRIEF DESCRIPTION OF DRAWINGS

The subject matter regarded as the invention will become more clearly understood in light of the ensuing description of embodiments herein, given by way of example and for purposes of illustrative discussion of the present invention only, with reference to the accompanying drawings (Figures, or simply "FIGS."), wherein.

Figure 1:
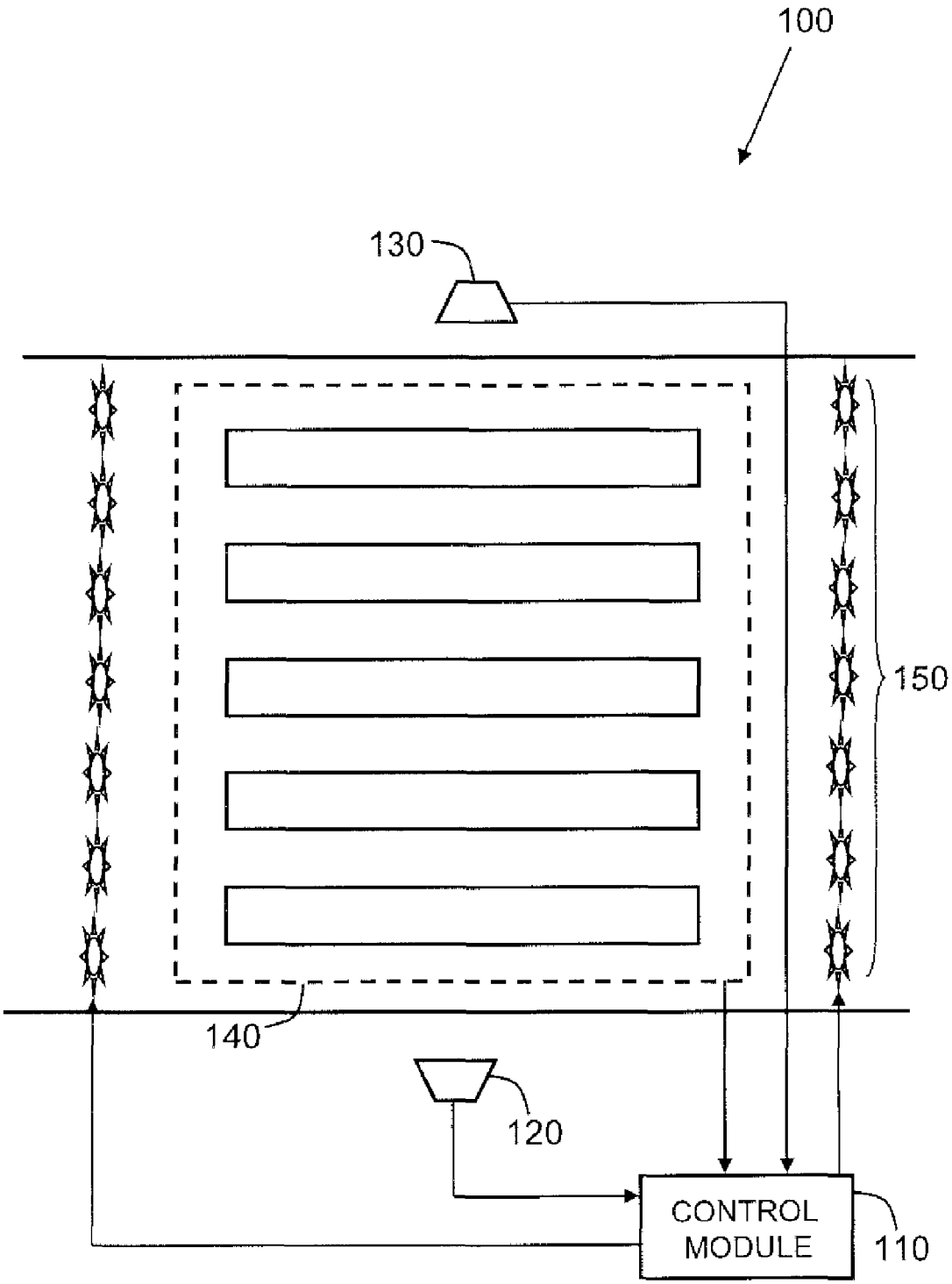
FIG. 1 is a schematic top view of the of a pedestrian crossing with the system according to some embodiments of the present invention.

The drawings together with the description make apparent to those skilled in the art how the invention may be embodied in practice.

Further, where considered appropriate, reference numerals may be repeated among the figures to indicate corresponding or analogous elements.

DETAILED DESCRIPTION OF THE INVENTION

FIG. 1 shows a schematic top view of a pedestrian crossing 100 with a block diagram representing the system according to some embodiments of the present invention. The system comprises at least one movement sensor 120, 130 connected to a control module 110. At least one weight sensor 140 is also connected to the control module 110. Finally, a plurality of illuminating indicators is connected to the control module 110. The movement sensor 120 is located such that it may sense any movement taking place on the pedestrian crossing 100 and anywhere in close proximity thereto. The weight sensor is preferably implemented by an electromagnetic inductive loop. These loops may sense the change of metal mass overlapping the loop. The weight sensor is located such that it may sense the change of metal mass upon the pedestrian crossing 100. The illuminating means may be located on both sides of the pedestrian crossing, along lines perpendicular to the road, wherein the lighting is directed at approaching vehicles of both directions.

The control module 110 is configured to receive data from both the movement sensor 120 and the weight sensor 140. The movement sensor 120 is configured and calibrated to detect a movement of any object (i.e., human, pets, cars) on any point upon the pedestrian crossing 100 and in close proximity thereto. The control module 110 is configured and calibrated to receive data from the weight sensor 140 and detect any vehicle passing along the pedestrian crossing 100. The combination of the data from both sensors, specifically, detecting a movement upon the pedestrian crossing 100, while negating the possibility that the said movement is a vehicle passing along the pedestrian crossing 100, causes the control module 110 to invoke the illuminating indicators 150 operating them such that driver approaching the pedestrian crossing 100 are alert to the presence of a pedestrian on the pedestrian crossing 100.

According to some embodiments of the invention, the movement sensor 120 may be implemented by a Doppler sensor, an Infra Red sensor, a volume sensor, a proximity sensor and the like. The main requirement is that the movement sensor will be sensitive enough to detect a movement of a human being.

The illuminating indicators 150 may be any form of low power light emitting diodes or the like that while having low power consumption, may still be effective in catching the drivers attention to the presence of a pedestrian upon the pedestrian crossing.

According to some embodiments of the invention, the weight sensor delivers a continuous value to the control module. This value corresponds to the total mass of vehicles present upon the monitored section of the road. By this, the control module may differentiate between passing and parking vehicles, wherein the latter are not counted for vehicle negating purposes. In other words, the system is configured to detect passing vehicles and only these vehicles negate the invoking of the illuminating indicators.

According to some embodiments of the invention, the second sensor is implemented with an inductive loop detecting the change in the magnetic flux going through it thereby detecting the mass of the object positioned upon it.

According to some embodiments of the invention, the system shall have an independent power source. This power source may operated by any form of solar energy conversion. Alternatively, the electricity required for powering the system shall be driven from a electricity network of the traffic indicators (traffic lights and the like).

According to some embodiments, the illuminating indicators are directed to both directions of the road. In addition, the control module is further configured to turn on the illuminating indicators for predetermined time duration, or alternatively, as long as a the pedestrian is still on the road.

Figure 2:
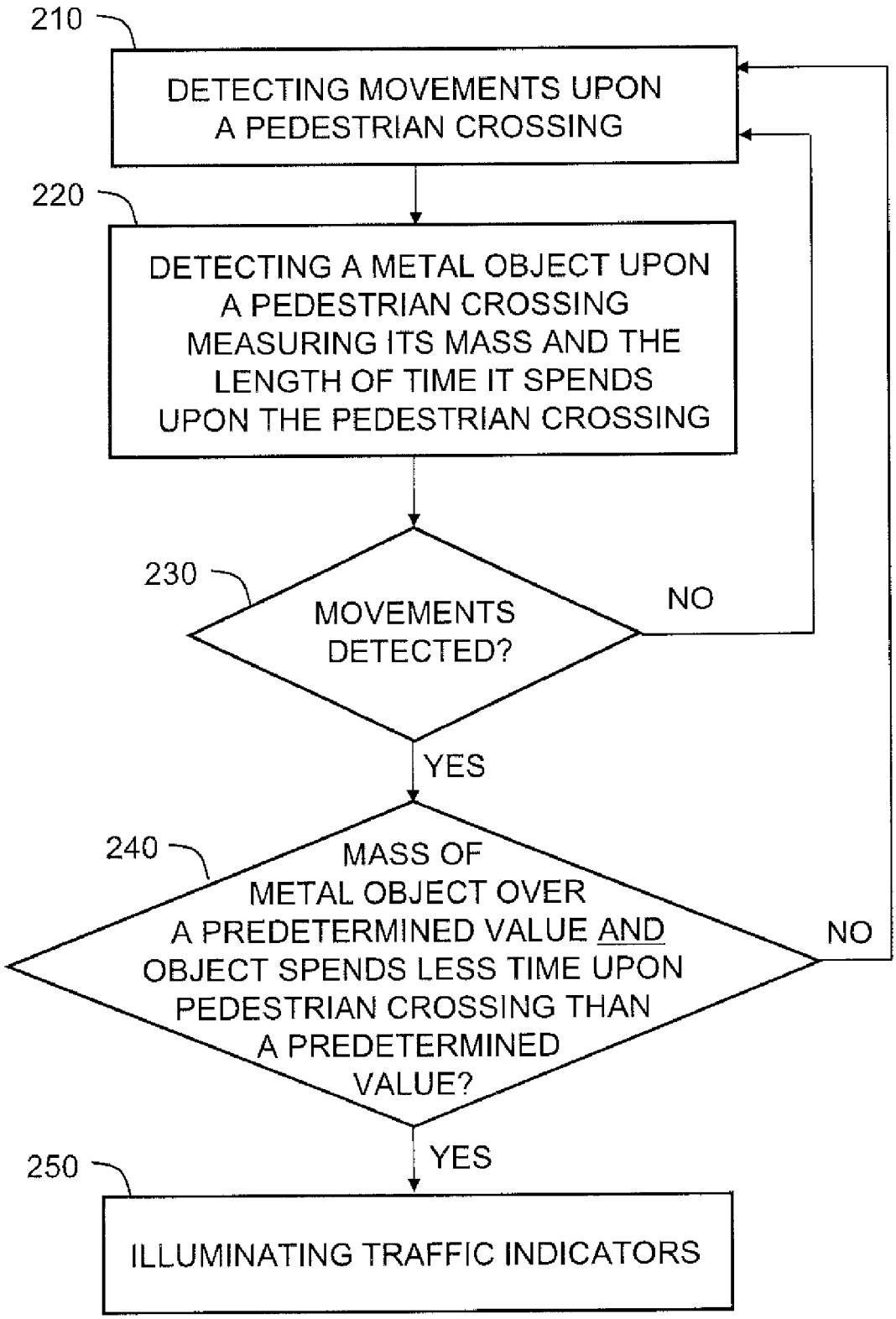
FIG. 2 is a flowchart diagram showing the steps of the method according to some embodiments of the present invention.

FIG. 2 is a flowchart diagram showing the steps of the method according to some embodiments of the present invention. Upon operation, movement upon the pedestrian crossing is carefully monitored. Both movement and weight are detected 210, 220. In the case that a movement is detected 230 and if and only if the weight of the object upon the pedestrian crossing does not exceed a predetermined value for a longer time interval than a predetermined value 240, then the illuminating indicators are turned on 250. The rationale of the aforementioned double checking is the following: a vehicle passing over the pedestrian crossing may also operate the movement sensor. The system may deal with such false alarm by negating the possibility that a mere passing vehicle operates the system. This is done by configuring the weight sensor to assert that a vehicle is passing by so that the illuminating indicators are not invoked. In the case that a vehicle is parked on top of the pedestrian crossing—it is canceled out by the control module which is further configured to check the length of time the weight is spending on top of the pedestrian crossing. In the case that the vehicle is stationary, the movement sensors are again enabled, detecting humans on top of the pedestrian crossing.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and substances presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention can be implemented in the testing or practice with methods and substances equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention While the invention has been described with respect to a limited number of embodiments, these should not be construed as limitations on the scope of the invention, but rather as exemplifications of some of the embodiments. Those skilled in the art will envision other possible variations, modifications, and applications that are also within the scope of the invention. Accordingly, the scope of the invention should not be limited by what has thus far been described, but by the appended claims and their legal equivalents. Therefore, it is to be understood that alternatives, modifications, and variations of the present invention are to be construed as being within the scope and spirit of the appended claims.

What is claimed is:

1. A system for alerting a driver to presence of a pedestrian on a road, said system comprising:

a first sensor configured to detect a pedestrian on a road; said first sensor connected to a control module; said control module connected to a second sensor configured to detect a vehicle on a road; and a plurality of illuminating indicators connected to said control module;

wherein said first sensor is positioned such that it senses any object positioned on a predetermined portion of the road;

and wherein said second sensor in positioned such that it monitors presence of any vehicle present of said portion of the road;

and wherein said control module is configured to receive data from said first sensor and from said second sensor and correspondingly invoke the illuminating indicators if and only if the first sensor detects a pedestrian on the road and movement was detected as a non-vehicular movement passing along the road.

2. The system according to claim 1, wherein the first sensor and the second sensor are movement sensors, and wherein the first sensor is configured to detect a human being movement and the second sensor in configured to detect a vehicular movement.

3. The system according to claim 1, wherein the first sensor and the second sensor are weight sensors, and wherein the first sensor is configured to detect a human being weight and the second sensor in configured to detect a vehicular weight.

4. The system according to claim 3, wherein the second sensor is implemented with an inductive loop detecting change in magnetic flux going through it thereby detecting the mass of the object positioned upon it.

5. The system according to claim 1, further comprising an electricity power source.

6. The system according to claim 5, wherein said power source is a solar energy source.

7. The system according to claim 5, wherein said power source is a traffic electricity network.

8. The system according to claim 1, wherein the control module is configured to turn on the illuminating indicators for predetermined time duration.

9. A method to alert a driver to presence of a pedestrian on a road, said method comprising the steps of:

detecting presence of a pedestrian on a predetermined road section;

detecting presence of a vehicle on said predetermined road section;

illuminating indicators alerting drivers to the presence of a pedestrian on said road section if and only if the presence of a pedestrian on the said road section was detected and the presence of a passing vehicle on said road section was not detected.

10. The method of claim 9, wherein detecting the presence of a pedestrian on a predetermined road section is performed by detecting a movement on the road.

11. The method of claim 9, wherein detecting the presence of a vehicle on said predetermined road section is performed by detecting a weight present on said road section.

12. The method of claim 9, wherein illuminating indicators alerting drivers to the presence of a pedestrian is performed for a predetermined duration of time.

13. The method of claim 9, wherein illuminating indicators alerting drivers to the presence of a pedestrian is performed as long as the pedestrian is on the said road section.

14. A system for alerting a driver to presence of a pedestrian on a road, said system comprising:

means for detecting presence of a pedestrian on a predetermined road section;

means for detecting presence of a vehicle on said predetermined road section;

means for illuminating indicators alerting drivers to the presence of a pedestrian on said road section if and only if the presence of a pedestrian on the said road section was detected and the presence of a passing vehicle on said road section was not detected.

15. The system of claim 14, wherein detecting the presence of a pedestrian on a predetermined road section is implemented with means for detecting a movement on the road.

16. The system of claim 14, wherein detecting the presence of a vehicle on said predetermined road section is implemented with means for detecting a weight present on said road section.

* * * * *